US008147983B2

(12) United States Patent
Suzuki et al.

(10) Patent No.: US 8,147,983 B2
(45) Date of Patent: Apr. 3, 2012

(54) TIN-PLATED STEEL SHEET

(75) Inventors: Takeshi Suzuki, Tokyo (JP); Noriko Makiishi, Tokyo (JP); Hiroki Iwasa, Tokyo (JP); Takumi Tanaka, Tokyo (JP); Tomofumi Shigekuni, Tokyo (JP)

(73) Assignee: JFE Steel Corporation (JP)

( * ) Notice: Subject to any disclaimer, the term of this patent is extended or adjusted under 35 U.S.C. 154(b) by 87 days.

(21) Appl. No.: 12/083,590

(22) PCT Filed: Oct. 20, 2006

(86) PCT No.: PCT/JP2006/321444

§ 371 (c)(1),
(2), (4) Date: Apr. 29, 2008

(87) PCT Pub. No.: WO2007/046549

PCT Pub. Date: Apr. 26, 2007

(65) Prior Publication Data

US 2009/0155621 A1 Jun. 18, 2009

(30) Foreign Application Priority Data

Oct. 20, 2005 (JP) ..... 2005-305765
Feb. 9, 2006 (JP) ..... 2006-032171

(51) Int. Cl.
*B32B 15/04* (2006.01)
*B32B 15/18* (2006.01)

(52) U.S. Cl. ..... 428/648; 428/633; 428/684; 428/685; 428/219; 428/340

(58) Field of Classification Search ..... 428/632, 428/633, 628, 629, 646, 648, 684, 685, 687, 428/219, 340
See application file for complete search history.

(56) References Cited

U.S. PATENT DOCUMENTS 4,306,917 A * 12/1981 Oda et al. ..... 148/261
5,498,300 A * 3/1996 Aoki et al. ..... 148/261

FOREIGN PATENT DOCUMENTS

JP 55-24516 A 2/1980
JP 58-41352 B2 9/1983
JP 1-32308 B2 6/1989
JP 6-173024 A 6/1994
JP 2001-316851 * 11/2001
JP 2004-060052 A 2/2004

OTHER PUBLICATIONS

Machine Translation, Shigekuni et al., JP 2001-316851, Nov. 2001.*

* cited by examiner

*Primary Examiner* — Michael Lavilla
(74) *Attorney, Agent, or Firm* — DLA Piper LLP (US)

(57) ABSTRACT

A tin-plated steel sheet includes a plating layer containing tin on at least one surface of a steel sheet, and a chemical conversion coating containing P and tin on the plating layer is provided. In the steel sheet, a coated amount of the chemical conversion coating per surface is 1.0 to 50 mg/m$^2$ in terms of P, an atomic ratio Sn/P obtained from the intensity of a P2p peak and that of a Sn3d peak is 1.0 to 1.5, the intensities being measured at the surface using an x-ray photoelectron spectroscopic method, and an atomic ratio O/P obtained from the intensity of the P2p peak and that of an O1s peak is 4.0 to 9.0. The phosphoric acid-based chemical conversion coating of the tin-plated steel sheet can suppress degradation in performance, which is caused by the growth of a tin oxide layer on the surface, instead of a conventional chromate coating.

3 Claims, 2 Drawing Sheets

TIN-PLATED STEEL SHEET

RELATED APPLICATIONS

This is a §371 of International Application No. PCT/JP2006/321444, with an international filing date of Oct. 20, 2006 (WO 2007/046549 A1, published Apr. 26, 2007), which is based on Japanese Patent Application Nos. 2005-305765, filed Oct. 20, 2005, and 2006-032171, filed Feb. 9, 2006.

TECHNICAL FIELD

This disclosure relates to tin-plated steel sheets for use in cans such as DI cans, food cans, and beverage cans and, more particularly, relates to a tin-plated steel sheet having on a surface thereof a chemical conversion coating which includes phosphoric acid, and a method for manufacturing the tin-plated steel sheet.

BACKGROUND

As surface-treated steel sheets for use in cans, tin-plated steel sheets, heretofore called "tinplates," have been widely used. In general, the tin-plated steel sheets as described above are immersed in an aqueous solution containing a hexavalent chromium compound, such as bichromic acid, or are electrolyzed in the above solution or are coated therewith to form chromate layers on the plated surfaces of the steel sheets. By the formation of chromate layers on the steel-sheet surfaces, oxidation of the tin-plated surfaces can be prevented during long-term storage, and degradation in appearance (yellowing) can be suppressed. In addition, when paint is applied to the tin-plated steel sheet before use, since the growth of a tin oxide layer is suppressed, cohesive failure of the tin oxide layer is prevented, and hence adhesion of the paint is ensured.

However, when the chromate coating is formed on the tin-plated steel sheet surface, since an aqueous solution containing a hexavalent chromium oxide is used as described above, to secure safety of working environment and to carry out an effluent treatment, a considerable cost is required. Furthermore, in case that a chromate processing solution unfortunately leaks out by accident or the like, it may probably cause very serious damage to the environment.

As described above, because of recent trend toward environmental conservation, movement for restriction of the use of chromium has proceeded in various fields, and a chemical conversion treatment containing no chromium has been increasingly required even for the tin-plated steel sheets.

According to the above current situation, various chemical conversion techniques instead of the chromate treatment have been proposed for tin-plated steel sheets for use in cans. For example, in Japanese Examined Patent Application Publication No. 55-24516, a surface treatment method for a tin-plated steel sheet has been disclosed which forms a chemical conversion coating containing no Cr on a tin-plated steel sheet by direct current electrolysis performed in a phosphoric acid-based solution using the tin-plated steel sheet as a cathode.

In Japanese Examined Patent Application Publication No. 1-32308, an electroplated tinplate for use in seamless cans has been disclosed in which a chemical conversion coating which contains P with or without Al and no Cr is provided on a tin plating layer surface.

In addition, in Japanese Examined Patent Application Publication No. 58-41352, a chemical conversion solution for treating metal surfaces, which contains phosphate ions, at least one type of chlorate and bromate, and tin ions, and which has a pH of 3 to 6, has been disclosed.

However, in view of suppression of performance degradation, such as degradation in appearance (yellowing phenomenon) and degradation in paint adhesion, caused by the growth of a tin oxide layer on a surface, it cannot be said that the chemical conversion coatings disclosed by the above conventional techniques have sufficient performance equivalent to that of a chromate coating obtained by a conventional solution containing bichromic acid.

In addition, a tin-plated steel sheet which is processed by a current chromate treatment is generally manufactured at a high speed, such as 300 m/min or more, and hence it has a high productivity. Accordingly, to replace the tin-plated steel sheet which is processed by a chromate treatment with a new chemical conversion treatment, the new chemical conversion treatment must be performed at a high speed at least equivalent to or more than that of the current process. As a rough index at which a chemical conversion treatment is performed at a high speed of 300 m/min or more, a chemical conversion time is preferably set to approximately 1 second. When the chemical conversion treatment is completed within 1 second, a treatment at a speed of 300 m/min can be performed, for example, by using one relatively small and vertical-shaped tank having an effective depth of approximately 2.5 m. However, as the treatment time is increased, the size of the treatment tank or the number thereof must be increased in order to ensure a passing time. As a result, equipment cost and maintenance cost thereof are both unfavorably increased.

It could therefore be advantageous to provide a tin-plated steel sheet and a manufacturing method thereof, the tin-plated steel sheet having a phosphoric acid-based chemical conversion coating instead of a conventional chromate coating, which can suppress the degradation in performance caused by the growth of a tin oxide layer on a surface. Furthermore, it could also be advantageous to provide a method which can manufacture the above mentioned steel sheet while high speed and high stability equivalent to those of a conventional chromate treatment process are maintained.

SUMMARY

We provide tin-plated steel sheets which comprise: a plating layer containing tin on at least one surface of a steel sheet; and a chemical conversion coating containing P and tin on the plating layer, wherein a coated amount of the chemical conversion coating per surface is about 1.0 to 50 mg/m$^2$ in terms of P, an atomic ratio Sn/P obtained from the intensity of a P2p peak and that of a Sn3d peak of the chemical conversion coating is in the range of 1.0 to 1.5, the intensities being measured at the surface thereof using an x-ray photoelectron spectroscopic method, and an atomic ratio 0/P obtained from the intensity of the P2p peak and that of an O1s peak is in the range of 4.0 to 9.0.

In the tin-plated steel sheet described above, a ratio $I_{OH}/I_{PO}$ between reflection-absorbance intensity of a PO bond ($I_{PO}$) and reflection-absorbance intensity of an OH bond ($I_{OH}$) of an infrared absorption spectrum of the chemical conversion coating is preferably in the range of 0.18 to 0.30.

In addition, we provide methods for manufacturing a tin-plated steel sheet, which comprise the steps of, after a plating layer containing tin is formed on at least one surface of a steel sheet, performing an immersion treatment or a cathode electrolytic treatment of the steel sheet in a chemical conversion solution which contains tin ions and phosphate ions, and then performing heating to 60 to 200° C.

In addition, according to this method for manufacturing a tin-plated steel sheet, the tin ions are preferably tetravalent tin ions.

DETAILED DESCRIPTION

Figure 1:
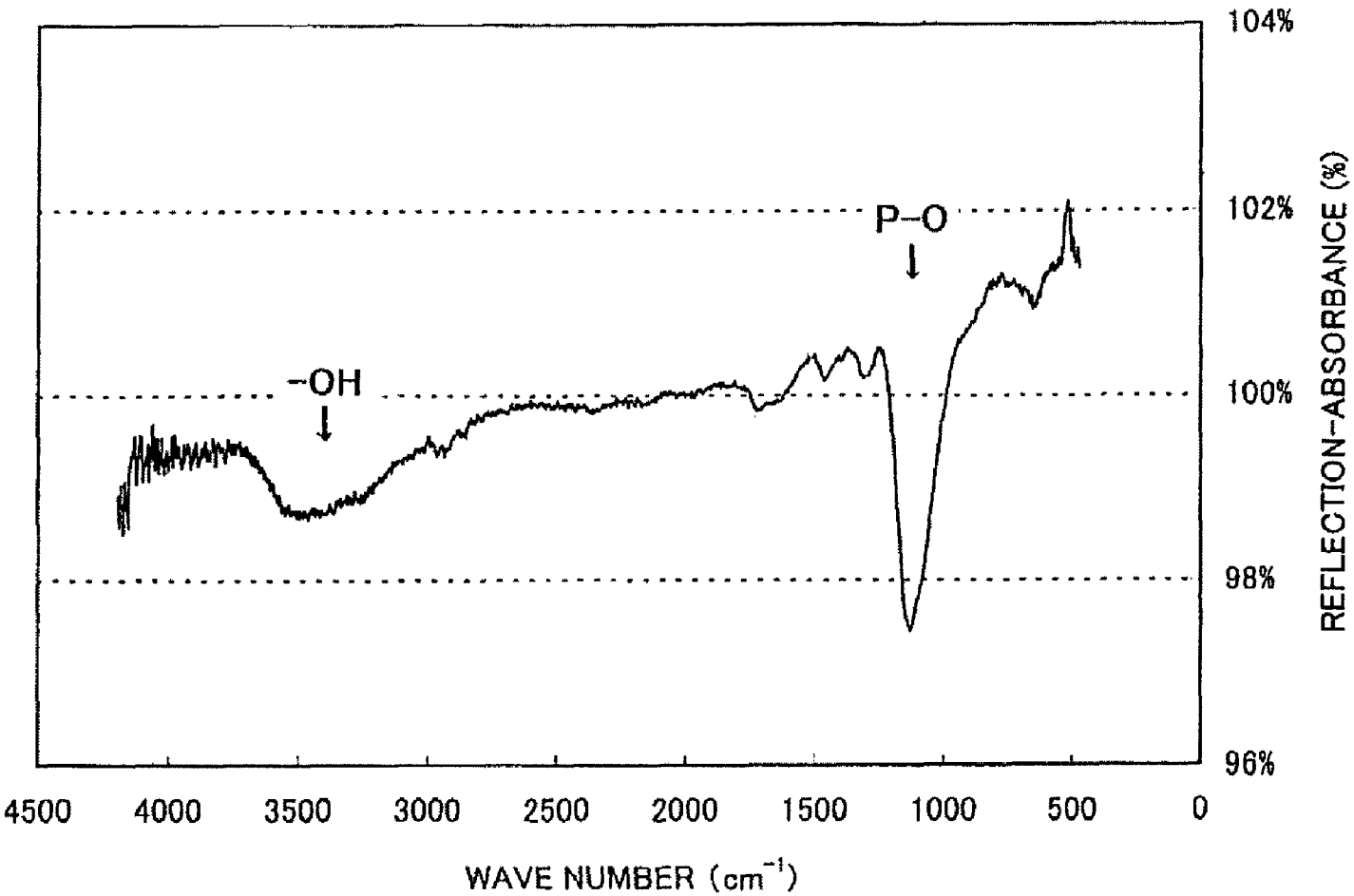
FIG. 1 is a graph showing the relationship between the wave number and the reflection-absorbance of an infrared absorption spectrum.

We carried out intensive research to obtain a tin-plated steel sheet having a phosphoric acid-based chemical conversion coating instead of a chromate coating, which can suppress the growth of a tin oxide layer on a surface. As a result, we found that a tin-plated steel sheet which suppresses the growth of a tin oxide layer on a surface and which has superior appearance, paint adhesion, and corrosion resistance can be obtained when atomic ratios of elements Sn, P and O contained in a chemical conversion coating, which are believed to be considerably responsible for suppressing the growth of a tin oxide layer on a surface and for improving the performance, are prescribed in addition to prescription of a coated amount of the chemical conversion coating and, furthermore, when a ratio $I_{OH}/I_{PO}$ between reflection-absorbance intensity of an PO bond ($I_{PO}$) and that of an OH bond ($I_{OH}$) of an infrared absorption spectrum is set in the range of 0.18 to 0.30.

The tin-plated steel sheet has a plating layer containing tin on at least one surface of the steel sheet and has a chemical conversion coating containing P and tin on the plating layer.

First, the "tin-plated steel sheet" includes all steel sheets processed by plating containing tin. Among those, a particularly preferable "tin-plated steel sheet" is a steel sheet having a plating layer containing tin, which is a metal tin layer, formed on an single intermediate layer formed of a Fe—Sn—Ni alloy layer or a Fe—Sn alloy layer or on an composite intermediate layer formed of a Fe—Ni alloy layer as a bottommost layer and a Fe—Sn—Ni alloy layer provided thereon. The addition amount of the plating layer is preferably in the range of 0.05 to 20 g/m$^2$ per one surface. When the addition amount is 0.05 g/m or more, sufficient corrosion resistance can be obtained. On the other hand, when the addition amount is more than 20 g/m$^2$, the plating layer has an excessively large thickness, and hence cost merit may not be obtained in some cases. The addition amount of Sn can be measured by a coulometric method or surface analysis using fluorescent x-rays.

Next, a chemical conversion coating containing P and tin, which is formed on the above plating layer, will be described. First, as the coated amount of the chemical conversion coating, 1.0 to 50 mg/m$^2$ in terms of P is necessary. The above coated amount is an important point. When the coated amount is less than 1.0 mg/m$^2$, since the covering performance of the chemical conversion coating is not sufficient, oxidation of tin cannot be sufficiently prevented, and hence sufficient paint adhesion cannot be obtained. On the other hand, when the coated amount is more than 50 mg/m$^2$, since defects such as cracks are liable to be generated in the coating, the paint adhesion and/or the corrosion resistance is degraded, and hence the coated amount is set to 50 mg/m$^2$ or less. In addition, the coated amount can be measured by surface analysis using fluorescent x-rays.

As the composition of the chemical conversion coating, it is necessary that the atomic ratio Sn/P between elements Sn and P obtained from the peak intensities of P2p and Sn3d of the chemical conversion coating measured at the surface thereof by an x-ray photoelectron spectroscopic method be in the range of 1.0 to 1.5 and that the atomic ratio O/P between elements O and P obtained from the peak intensities of P2p and O1s be in the range of 4.0 to 9.0. The atomic ratios described above are also very important points as the coated amount of the chemical conversion coating described above.

As compounds of phosphoric acid and tin, there are tin (II) dihydrogen phosphate ($Sn(H_2PO_4)_2$), tin (II) hydrogen phosphate ($SnHPO_4$), and tin (II) phosphate ($Sn_3(PO_4)_2$), and in an aqueous solution, the following equilibrium relationships represented by formulas (1) and (2) hold:

$$(Sn(H_2PO_4)_2) \rightleftharpoons SnHPO_4 + H_3PO_4 \quad (1)$$

$$3SnHPO_4 \rightleftharpoons Sn_3(PO_4)_2 + H_3PO_4 \quad (2).$$

Since also being applied to an inside surface of a can, the chemical conversion coating is required to be stably present while it is in contact with a can content including a water component. Since being soluble to water, tin (II) dihydrogen phosphate is liable to be dissolved into the content and, as a result, the stability of the coating may be degraded in some cases. Accordingly, it is necessary that the chemical conversion coating be formed of tin (II) hydrogen phosphate, tin (II) phosphate, or a mixture thereof. When the points described above are taken into consideration, the atomic ratio Sn/P between the elements Sn and P is 1.0 when the content of tin (II) hydrogen phosphate is 100% and is 1.5 when the content of tin (II) phosphate is 100%. Hence, the atomic ratio Sn/P between the elements Sn and P is set in the range of 1.0 to 1.5. When the atomic ratio Sn/P is less than 1.0, since tin (II) dihydrogen phosphate remains in the coating, a soluble component is dissolved into the content and, as a result, the corrosion resistance is degraded. On the other hand, when the atomic ratio exceeds 1.5, this atomic ratio cannot be present from a stoichiometric point of view.

In addition, according to the above formulas (1) and (2), the atomic ratio O/P is 4.0 in terms of stoichiometry. However, structurally, when an orthophosphoric acid is heated to a high temperature, since dehydration polymerization reaction occurs, the atomic ratio O/P is decreased to less than 4.0, and a metaphosphoric acid ($PO_3$—) is finally formed; hence, the atomic ratio O/P is decreased to 3.0. As a result, when the dehydration from orthophosphoric acid structure occurs by heating, cracking is liable to occur in the coating due to volume contraction and, consequently, barrier properties are degraded. In addition, since oxidation of tin occurs by heating, the appearance is also degraded. Hence, to maintain the corrosion resistance and the appearance and to prevent the dehydration reaction, it is not preferable that the atomic ratio O/P be decreased to less than 4.0.

In addition, when a phosphoric acid-based coating is actually formed by using an aqueous solution, the atomic ratio O/P is more than 4.0 in many cases. This result indicates that besides phosphoric acid and tin, water is trapped in the coating in the form of an adsorbate or a hydrate. A phosphoric acid-tin coating functions as a barrier suppressing transmission of water and oxygen into a tin plating layer from the surrounding environment. However, when a large amount of water is present in the coating, the chemical conversion coating itself functions as a supply source of oxygen and, as a result, oxidation of the tin plating layer is promoted. Accordingly, to suppress oxidation of the tin plating layer and to prevent degradation in appearance, such as yellowing, and degradation in paint adhesion, it is preferable that a large amount of water, which functions as a corrosion promotion factor, be not present in the coating. In particular, when water in a large amount is present in the coating, and the atomic ratio O/P is more than 9.0, although the chemical conversion coating is present, the growth of a tin oxide layer cannot be sufficiently suppressed and, as a result, the surface is covered with the tin oxide layer; hence, various problems, such as degradation in the appearance by yellowing and degradation in the adhesion by cohesion failure of the thin oxide film, occurs in practice. Hence, the atomic ratio O/P is set in the range of 4.0 to 9.0.

The atomic ratios described above can be obtained by measuring the peaks of O1s, P2p, and Sn3d at the surface using x-ray photoelectron spectroscopic measurement, followed by calculation based on atomic concentration obtained using quantitative software for x-ray photoelectron spectroscopy. As one example of the quantitative software, Vision. 2 of KRATOS Analytical Inc. may be mentioned. Since O1s is considerably influenced by adsorption components and contamination present on the topmost surface, to correlate the peak of O1s with properties of the coating, analysis is preferably performed after the influence of contamination is reduced by performing mild sputtering and so forth. In addition, a relative sensitivity factor method has been widely used for quantitative determination, and by using peak intensity or peak area intensity of a target element, calculation can be performed using a factor stored beforehand in an apparatus or that obtained by measurement of a standard substance.

Furthermore, the ratio $I_{OH}/I_{PO}$ between reflection-absorbance intensity of a PO bond ($I_{PO}$) and that of an OH bond ($I_{OH}$) of the chemical conversion coating obtained by an infrared absorption spectrum is preferably in the range of 0.18 to 0.30. The amount of water in the chemical conversion coating can also be determined by the ratio $I_{OH}/I_{PO}$, that is, the ratio between the absorption intensity of a PO bond ($I_{PO}$) and the absorption intensity of an OH bond ($I_{OH}$) of the chemical conversion coating obtained by an infrared absorption spectrum. To quantitatively evaluate the infrared absorption spectrum of an ultra thin surface coating as described above, an FT-IR (Fourier transform infrared spectrophotometer) device was used, and measurement was performed using a high sensitive reflection method. In particular, an FT-IR device: JIR-100 manufactured by JEOL Ltd. was used; in the high-sensitive reflection measurement, incident light was parallel polarized light, and the incident angle was set to 70°; and the resolution was 4 $cm^{-1}$, the number of acquisition was 200, and measurement was performed using a wide-band MCT detector as a detector. As a reference sample, a steel sheet having only a tin layer plated thereon and no chemical conversion coating was used, and a difference spectrum from the reference sample was obtained. As shown in FIG. 1, $I_{OH}$ and $I_{PO}$ are the intensity of the absorption peak of an OH bond observed at a wave number of about 3,510 $cm^{-1}$ and the intensity of the absorption peak of a PO bond observed at a wave number of about 1,130 $cm^{-1}$ of the IR absorption spectrum of the chemical conversion coating, respectively. $I_{OH}/I_{PO}$ is obtained by the steps of measuring the peak intensity of OH in the vicinity of 3,510 $cm^{-1}$ and the peak intensity of phosphoric acid in the vicinity of 1,130 $cm^{-1}$, subtracting the background from the respective intensities to obtain different spectra, and then calculating the ratio therefrom.

When $I_{OH}/I_{PO}$ is more than 0.30, since the amount of water is excessive in the chemical conversion coating, the growth of a tin oxide cannot be sufficiently suppressed and, as a result, the surface is covered with the oxide film; hence, various problems, such as degradation in the appearance by yellowing and degradation in the adhesion by cohesion failure of the thin oxide film, may practically occur in some cases. Hence, $I_{OH}/I_{PO}$ is preferably set to 0.30 or less. Furthermore, to stably maintain the properties, $I_{OH}/I_{PO}$ is preferably set to 0.28 or less. On the other hand, when $I_{OH}/I_{PO}$ is less than 0.18, although the amount of water in the chemical conversion coating is small, this ratio is obtained by performing excessive heating; hence, as a result, a large amount of a tin oxide is unfavorably formed on the surface, and the appearance and/or the adhesion may be unexpectedly degraded in some cases. Accordingly, $I_{OH}/I_{PO}$ is preferably 0.18 or more.

Next, a method for manufacturing the tin-plated steel sheet will be described. First, on a steel sheet having a plating layer containing tin on at least one surface thereof, a chemical conversion coating containing P and tin is formed. As a formation method, for example, there may be mentioned 1) a method immersing a steel sheet in an aqueous solution containing phosphoric acid and/or a metal salt such as sodium phosphate and/or potassium phosphate, and 2) a method for performing an immersion treatment or a cathode electrolytic treatment of a steel sheet in a chemical conversion solution containing tin ions, preferably tetravalent tin ions, and phosphate ions.

The method 1) described above is a general method. In the method 1), the surface of the tin plating and a phosphoric acid source, such as phosphoric acid and/or a metal salt thereof, such as sodium phosphate and/or potassium phosphate, react with each other and, as a result, for example, tin (II) dihydrogen phosphate is formed as shown by formula (3):

$$H_3PO_4+Sn \rightleftharpoons Sn(H_2PO_4)_2+H_2 \quad (3).$$

Tin (II) dihydrogen phosphate has the equilibrium relationship with tin (II) hydrogen phosphate and tin (II) phosphate, as shown by the formulae (1) and (2). In addition, according to the formula (3), when tin (II) dihydrogen phosphate is formed, hydrogen gas is simultaneously generated. As a result, since protons are consumed in the vicinity of the steel sheet interface, pH is increased, and tin (II) hydrogen phosphate and tin (II) phosphate precipitate, resulting in formation of a coating on the steel sheet.

According to the above method 1), although the chemical conversion coating containing P and tin can be actually precipitated on the plating layer, the reaction time is long, such as approximately 5 to 10 seconds. Hence, when the coating is formed at a high speed, the above method is not advantageous.

On the other hand, according to the above method 2), that is, according to the method for performing an immersion treatment or a cathode electrolytic treatment of a steel sheet in a chemical conversion solution formed by adding tin ions, preferably tetravalent tin ions, to an aqueous solution containing phosphate ions, the speed of coating precipitation can be significantly improved. Hence, the method 2) is preferable since the precipitation speed can be improved as described above. The reason for this is believed as follows.

First, to facilitate the formation of tin (II) dihydrogen phosphate shown by the formula (3), it is effective to increase the concentration of tin ions in the solution. From this point of view, it is preferable that tin ions be contained in the chemical conversion solution. However, when a large amount of divalent tin ions is added to an aqueous solution containing phosphate ions, since sludge is generated in the solution, uniform adhesion of the coating may be degraded and, as a result, a sufficient effect may not be obtained in some cases. On the other, when tetravalent tin ions are added, the formation of sludge in the solution is suppressed, and a larger amount of tin ions can be added as compared to the case of divalent tin ions.

Furthermore, the precipitation of coating is improved as compared to the case in which divalent tin ions are added. The tetravalent tin ions dissolved in the solution are reduced to divalent tin ions in the vicinity of the steel sheet interface by electron emission concomitant with dissolution of the tin plating surface. Hence, as a result, the same effect as that obtained by adding divalent tin ions at a high concentration to the vicinity of the interface is obtained, and hence the reaction speed is significantly increased. Furthermore, when electrolysis is performed by using the steel sheet as the cathode, since reduction of tetravalent tin ions to divalent tin ions is promoted, and reduction reaction of protons is also promoted, precipitate deposition of tin (II) hydrogen phosphate and tin (II) phosphate is promoted by increase in pH in the vicinity of the interface; hence, a more significant reaction promoting effect can be obtained. As a result, when an immersion treatment or a cathode electrolytic treatment of a steel sheet is performed in a chemical conversion solution prepared by adding tetravalent tin ions to an aqueous solution containing phosphate ions, the formation of the coating can be performed in a short period of time, such as 1 second or less, and hence the coating can be stably formed in a processing time equivalent to that of a current chromate treatment.

Accordingly, as the method for forming a chemical conversion coating containing P and tin on a steel sheet having a plating layer containing tin on at least one surface thereof, a method for performing an immersion treatment or a cathode electrolytic treatment of a steel sheet in a chemical conversion solution containing tin ions, preferably tetravalent tin ions, and phosphate ions is preferable, and by this method, the treatment can be stably performed at a speed (high speed) equivalent to that of a chromate treatment process. For example, when divalent tin ions are added, stannous chloride or stannous sulfate is used, and when tetravalent tin ions are added, tin salt such as stannic chloride or stannic iodide is used, or stannic oxide dissolved in an acid is used; hence, an adding method is not particularly limited. In addition, when phosphate ions are added, orthophosphoric acid, sodium phosphate, or the like is preferably added so as to be contained in the chemical conversion solution in the form of orthophosphate ions. Furthermore, the treatment time may be optionally determined in accordance with a necessary P adhesion amount.

Figure 2:
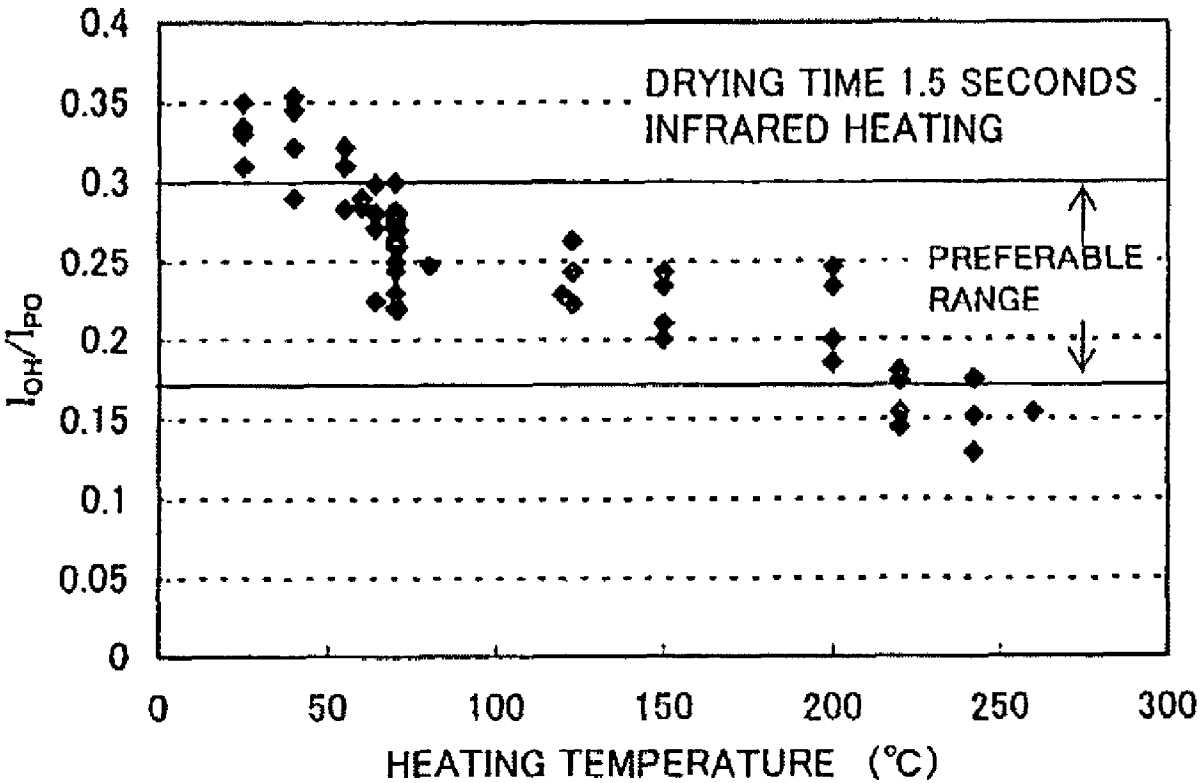
FIG. 2 is a graph showing the relationship between a heating temperature and a ratio $I_{OH}/I_{PO}$ of an infrared absorption spectrum.

Next, the steel sheet having the chemical conversion coating formed as described above is heated to a temperature of 60 to 200° C. The chemical conversion coating formed by the above electrolysis or immersion treatment contains a large amount of adsorption water or hydrated water therein when any process is not performed therefor, and hence the atomic ratio O/P of the chemical conversion coating cannot be decreased to 9.0 or less. To decrease the atomic ratio O/P to 9.0 or less, after being formed, the chemical conversion coating must be heated to 60° C. or more. When the temperature is less than 60° C., a dehydration effect for the chemical conversion coating is low, and the atomic ratio O/P cannot be decreased to 9.0 or less within a short period of time. On the other hand, when the temperature is more than 200° C., although the dehydration effect by the heat treatment is significant, a large amount of a tin oxide layer is formed on the surface by the heat treatment itself and, as a result, the appearance and adhesion are unexpectedly degraded. In addition, when the temperature is further increased, dehydration condensation (formation of metaphosphate structure) of orthophosphate structure starts to occur, and as a result, corrosion resistance of the coating is also degraded. Hence, the temperature must be set to 200° C. or less. In addition, as shown in FIG. 2, the heating temperature for the steel sheet also has a relationship with $I_{OH}/I_{PO}$. Accordingly, also to obtain an $I_{OH}/I_{PO}$ in the range of 0.18 to 0.30, the heating temperature for the steel sheet must be set in the range of 60 to 200° C. The heating method is not particularly limited, and a general heating method which is industrially performed, such as heating by hot-wind blowing, infrared heating, induction heating, or radiation heating, is preferably used.

To the chemical conversion solution, metal salts of Fe and Ni, such as $FeCl_2$, $NiCl_2$, $FeSO_4$, and $NiSO_4$, may be optionally added. In this case, as a promoter, an oxidizing agent, such as sodium chlorate or a nitrite, and an etching agent, such as fluorine ions, may also be optionally added.

In addition, to improve uniform processing properties of the chemical conversion solution, a surfactant, such as sodium lauryl sulfate or acetylene glycol, may also be added.

Furthermore, to form the chemical conversion coating in a short period of time by increasing the content of tin ions in the chemical conversion solution, an oxidizing agent may also be optionally added. As the oxidizing agent, for example, hydrogen peroxide, potassium permanganate, sodium iodate, nitric acid, peracetic acid, a chlorate, and a perchlorate may be mentioned.

Accordingly, the tin-plated steel sheet is obtained. In accordance with the above description, one example of the manufacturing method will be described.

After Sn plating is performed on a cold-rolled steel sheet, a heat melting (reflow) treatment is performed at a tin melting point (231.9° C.) or more, so that a tin-based plating layer composed of two layers, that is, a Fe—Sn alloy layer (intermediate layer) and a metal Sn layer (upper layer), is formed. Next, after the reflow treatment, to remove a tin oxide layer formed on the surface, a cathode treatment is performed at 1 to 3 C/dm$^2$ in an aqueous solution of sodium carbonate at a concentration of 10 to 15 g/L (L is an abbreviation for litter). Subsequently, the chemical conversion treatment is performed by an immersion treatment or a cathode electrolytic treatment. As the chemical conversion solution, an aqueous solution containing phosphoric acid at a concentration of 1 to 80 g/L and stannic chloride at a concentration of 0.5 to 5 g/L is used. As the chemical conversion treatment conditions, the temperature is in the range of 40 to 80° C. and, in the case of the immersion treatment, the immersion time is set to 1 to 2 seconds. In addition, in the case of the cathode electrolytic treatment, the electrolytic time and the current density are set to 0.5 to 1 second and 0.5 to 10 A/dm$^2$, respectively. After the chemical conversion treatment, wringing is performed by a wringer roll, and heating to 60 to 200° C. is then performed by an infrared heating device for heating, followed by water washing and drying by cold wind at room temperature. As a result, a tin-plated steel sheet having a phosphoric acid-based chemical conversion coating can be obtained, the chemical conversion coating having a coated amount of 1.0 to 50 mg/m$^2$ in terms of P, an atomic ratio Sn/P of 1.0 to 1.5, an atomic ratio O/P of 4.0 to 9.0, and $I_{OH}/I_{PO}$ of an infrared absorption spectrum of 0.18 to 0.30. By the way, since the above method is only described by way of example, various modifications may be made.

EXAMPLES

Selected, representative examples will be described in detail.

Example 1

After a tin plating layer in an amount of 10 g/m$^2$ per surface was formed on both surfaces of a cold-rolled low-carbon steel sheet having a thickness of 0.2 mm using a commercially available tin plating solution, a heat melting (reflow) treatment was performed at a tin melting point (231.9° C.) or more. Next, after the reflow treatment, to remove a tin oxide layer formed on the surfaces, a cathode treatment was performed at 1 C/dm$^2$ in an aqueous solution of sodium carbonate having a concentration of 10 g/L at a bath temperature of 50° C. Subsequently, after water washing, a cathode electrolytic treatment was performed in an aqueous solution containing phosphoric acid at a concentration of 6.0 g/L and stannic chloride pentahydrate at a concentration of 2.7 g/L at a current density of 10 A/dm$^2$ and a bath temperature of 60° C. for 1 second. Furthermore, after the cathode electrolytic treatment, wringing was performed by a wringer roll, and heating was then performed by an infrared heating device for heating under conditions so that a steel sheet temperature of 70° C. was obtained, followed by water washing and drying by cold wind, thereby forming a chemical conversion coating containing P and tin and having a coated amount of 8.3 mg/m$^2$ in terms of P on the plating layer. Measurement of the P addition amount was performed using a fluorescent x-ray analysis by comparing with a calibration plate having an addition amount which was measured beforehand by a wet analysis. In addition, as described below, the atomic ratios Sn/P and O/P of the chemical conversion coating were measured at the surface thereof by x-ray photoelectron spectroscopic measurement, and the atomic ratio Sn/P was 1.3 and the atomic ratio O/P was 6.0. Furthermore, $I_{OH}/I_{PO}$ of an infrared absorption spectrum measured by the above-described high sensitive reflection method was 0.28.

(Measurement by X-Ray Photoelectron Spectroscopic (XPS) Method)

After each sample was placed in an apparatus, mild Ar sputtering was performed to remove surface contamination, and quantitative analysis was then performed. For this removal of surface contamination, conditions were roughly selected so that a C1s peak was 5 atomic percent or less by a quantitative analysis using a relative sensitivity factor method. After the removal of surface contamination, peak strengths of P2p, O1s, and Sn3d were measured and were then converted into atomic concentrations using a relative sensitivity factor method. Furthermore, using the atomic concentrations, atomic ratios Sn/P and O/P were calculated. For this calculation, values stored in XPS manufactured by KRATOS Analytical Inc. were used as the relative sensitivity factor. In general, standard relative sensitivity factor are stored in each XPS apparatus, and hence a semi-quantitative analysis can be performed. However, when the quantitative data are to be discussed, the quantitative accuracy of the analysis is preferably confirmed beforehand by using a material which is similar to the sample as much as possible and which has a well-understood composition. In this example, $Na_2PO_4$ and $SnO_2$ were used, and after it was confirmed that a quantitative analysis could be performed at an accuracy of approximately ±10%, such that an atomic ratio O/P of 3.6 to 4.4 and an atomic ratio Sn/0 of 0.45 to 0.55 were obtained from $Na_2PO_4$ and $SnO_2$, respectively, the measurement was performed. Since the value obtained thereby can be improved in terms of accuracy and representativeness by increasing the number of analysis points, at least 3 points having a diameter of 100 μm were measured for each sample, and the average was calculated therefrom.

Examples 2 to 15

A plating treatment was performed on both surfaces of a cold-rolled low-carbon steel sheet having a thickness of 0.2 mm in the manner equivalent to that in Example 1, so that a plating layer was formed. Next, in an aqueous solution containing phosphoric acid or a sodium phosphate and stannic chloride pentahydrate or stannic iodide, each having the concentration shown in Table 1, a cathode electrolytic treatment was performed at the current density for the time shown in Table 1. Alternatively, an immersion treatment was performed for the time shown in Table 1. Furthermore, after the above treatment, wringing was performed using a wringer roll, and heating was then performed by an infrared heating device for heating under conditions so that a steel sheet temperature shown in Table 1 was obtained. Subsequently, by water washing and drying by cold wind, a chemical conversion coating containing P was formed.

As for the tin-plated steel sheet obtained as described above, in the manner equivalent to that in Example 1, the P addition amount, the atomic ratios Sn/P and O/P of the chemical conversion coating, and $I_{OH}/I_{PO}$ thereof were measured. The results are shown in Table 1 together with the conditions.

Example 16

After a tin plating layer in an amount of 10 g/m$^2$ per surface was formed on both surfaces of a cold-rolled low-carbon steel sheet having a thickness of 0.2 mm using a commercially available tin plating solution, a heat melting (reflow) treatment was performed at a tin melting point (231.9° C.) or more. Next, after the reflow treatment, to remove a tin oxide formed on the surfaces, a cathode treatment was performed at 1 C/dm$^2$ in an aqueous solution of sodium carbonate having a concentration of 10 g/L at a bath temperature of 50° C. Subsequently, after water washing, a cathode electrolytic treatment was performed in an aqueous solution containing phosphoric acid at a concentration of 6.0 g/L and stannic chloride pentahydrate at a concentration of 2.7 g/L at a current density of 10 A/dm$^2$ and a bath temperature of 60° C. for 1 second. Furthermore, water washing was performed after the cathode electrolytic treatment, wringing was performed by a wringer roll, and heating was then performed by an infrared heating device for heating under conditions so that a steel sheet temperature of 70° C. was obtained; hence, as a result, a chemical conversion coating composed of tin phosphate having a coated amount of 7.0 mg/m$^2$ in terms of P was formed. As for the tin-plated steel sheet obtained as described above, in the manner equivalent to that in the above example, the P addition amount, the atomic ratios Sn/P and O/P of the chemical conversion coating, and $I_{OH}/I_{PO}$ thereof were measured. The results are shown in Table 1 together with the conditions.

Examples 17 to 19

A plating treatment was performed on both surfaces of a cold-rolled low-carbon steel sheet having a thickness of 0.2 mm in the manner equivalent to that in Example 1, so that a plating layer was formed. Next, in an aqueous solution containing phosphoric acid and stannous chloride or tin sulfate, each having the concentration shown in Table 1, a cathode electrolytic treatment was performed at the current density for the time shown in Table 1. Alternatively, an immersion treatment was performed for the time shown in Table 1. Subsequently, wringing was performed by a wringer roll, and heating was performed by an infrared heating device for heating under conditions so that a steel sheet temperature shown in Table 1 was obtained, followed by water washing and drying by cold wind, thereby forming a chemical conversion coating containing P and tin.

As for the tin-plated steel sheet obtained as described above, in the manner equivalent to that in Example 1, the P addition amount, the atomic ratios Sn/P and O/P of the chemical conversion coating, and $I_{OH}/I_{PO}$ thereof were measured. The results are shown in Table 1 together with the conditions.

Comparative Examples 1 to 7

For comparison purposes, a tin-plated steel sheet was formed. However, a method for forming a chemical conversion coating used therefor, the P addition amount, and the composition were out of our ranges. A plating treatment was performed on both surfaces of a cold-rolled low-carbon steel sheet having a thickness of 0.2 mm in the manner equivalent to that in Example 1, so that a plating layer was formed. Next, in an aqueous solution containing orthophosphoric acid and stannic chloride pentahydrate or stannous chloride dihydrate, each having the concentration shown in Table 1, a cathode electrolytic treatment was performed at the current density for the time shown in Table 1. Alternatively, an immersion treatment was performed for the time shown in Table 1. Subsequently, wringing was performed by a wringer roll, and heating was then performed by an infrared heating device for heating under conditions so that a steel sheet temperature shown in Table 1 was obtained, followed by water washing and drying by cold wind, thereby forming a chemical conversion coating composed of tin phosphate. As for the tin-plated steel sheet obtained as described above, in the manner equivalent to that in Example 1, the P addition amount, the atomic ratios Sn/P and O/P of the chemical conversion coating, and $I_{OH}/I_{PO}$ thereof were measured. The results are shown in Table 1 together with the conditions.

Next, for the individual tin-plated steel sheets processed by the chemical conversion treatments in the examples and the comparative examples, to evaluate the performance of the chemical conversion coating, growth properties of a tin oxide layer, paint adhesion, and corrosion resistance were investigated as described below. The evaluation results are shown in Table 2.

(Evaluation of Growth Properties of Tin Oxide Layer)

After the tin-plated steel sheets of the examples and the comparative examples were each stored under circumstances at a temperature of 60° C. and at a relative humidity of 70% for 10 days, the amount of a tin oxide layer formed on the surface was evaluated by an electric quantity which was required for electrolytic reduction. An HBr solution at a concentration of 1/1,000 N was used as an electrolyte, and electrolysis was performed at a current density of 25 μA/cm$^2$.

○ - - - electric quantity for reduction: less than 3 mC/cm$^2$, Appearance: excellent (equivalent to that of a chromate treated material)

Δ - - - electric quantity for reduction: 3 to less than 5 mC/cm$^2$, Appearance: slightly yellowing x - - - electric quantity for reduction: 5 mC/cm$^2$ or more, Appearance: apparently yellowing (Evaluation of Paint Adhesion)

After an epoxy-phenol-based paint in an addition amount of 50 mg/dm$^2$ was applied on the surface of the tin-plated steel sheet of each of the examples and the comparative examples, heating was performed at 210° C. for 10 minutes. Next, two tin-plated steel sheets thus prepared by application and heating were laminated to each other so that the paint-applied surfaces thereof faced each other with a nylon adhesive film interposed therebetween and were then adhered to each other at a pressure of $2.94\times10^5$ Pa and at a temperature of 190° C. for a pressing time of 30 seconds. Subsequently, the sample thus formed was cut into test pieces having a width of 5 mm, and this test piece was peeled off to each other by a tensile test machine, so that peeling strength measurement was performed.

◎ - - - 4.50 N (0.5 kgf) or more

○ - - - 3.92 N (0.4 kgf) to less than 4.50 N (0.5 kgf) (equivalent to that of a chromate treated material)

Δ - - - 1.96 N (0.2 kgf) to less than 3.92 N (0.4 kgf)

x - - - less than 1.96 N (0.2 kgf)

(Evaluation of Corrosion Resistance)

After an epoxy-phenol-based paint in an addition amount of 50 mg/dm$^2$ was applied on the surface of the tin-plated steel sheet of each of the examples and the comparative examples, heating was performed at 210° C. for 10 minutes. Subsequently, after the tin-plated steel sheet thus processed was immersed in a commercially available tomato juice at 60° C. for 10 days, delamination of the paint film and generation of rust were inspected by visual observation.

◎ - - - No delamination of paint film, and no rust generation

○ - - - No delamination of paint film, and very slight generation of point-shaped rust (equivalent to that of a chromate treated material)

Δ - - - No delamination of paint film, and generation of minute rust x - - - Delamination of paint film, and generation of rust From Table 2, the growth properties of a tin oxide layer, the paint adhesion, and the corrosion resistance of the examples 1 to 19 are all superior. On the other hand, the growth properties of a tin oxide layer, the paint adhesion, or the corrosion resistance of the comparative examples 1 to 7 is inferior, and it was found that they cannot be practically used.

A tin-plated steel sheet which suppresses the growth of a tin oxide layer and which has superior appearance, paint adhesion, and corrosion resistance can be obtained. As a result, although a chromate coating is not formed on a tin-plated steel sheet, which has a function of improving coating properties thereof but is unfavorable in view of environmental conservation, our tin-plated steel sheets are able to have excellent various properties equivalent or superior to those of a plated steel sheet having a chromate coating. In addition, the tin-plated steel sheets can be processed at a high speed equivalent to that of a tin-plated steel sheet processed by a chromate treatment, and hence superior productivity can also be obtained in industrial mass production.

TABLE 1

| | CHEMICAL CONVERSION SOLUTION | | | | | ELECTROLYSIS TREATMENT | |
|---|---|---|---|---|---|---|---|
| | PHOSPHORIC ACID SOURCE | | TIN SOURCE | | | | |
| | COMPOUND | ADDITION AMOUNT (g/L) | COMPOUND | ADDITION AMOUNT (g/L) | TEMPERATURE (° C.) | CURRENT DENSITY (A/dm$^2$) | ELECTROLYSIS TIME (SEC) |
| EXAMPLE 1 | $H_3PO_4$ | 6.0 | $SnCl_4\cdot5H_2O$ | 2.7 | 60 | 10 | 1.0 |
| EXAMPLE 2 | $H_3PO_4$ | 6.0 | $SnCl_4\cdot5H_2O$ | 2.7 | 60 | 6 | 1.0 |
| EXAMPLE 3 | $H_3PO_4$ | 6.0 | $SnCl_4\cdot5H_2O$ | 2.7 | 60 | 3 | 1.0 |
| EXAMPLE 4 | $H_3PO_4$ | 6.0 | $SnCl_4\cdot5H_2O$ | 2.7 | 60 | 3 | 1.0 |

TABLE 1-continued

| | | | | | | | |
|---|---|---|---|---|---|---|---|
| EXAMPLE 5 | $H_3PO_4$ | 6.0 | $SnCl_4 \cdot 5H_2O$ | 2.7 | 60 | 3 | 1.0 |
| EXAMPLE 6 | $H_3PO_4$ | 6.0 | $SnCl_4 \cdot 5H_2O$ | 2.7 | 60 | 3 | 1.0 |
| EXAMPLE 7 | $H_3PO_4$ | 6.0 | $SnCl_4 \cdot 5H_2O$ | 1.4 | 60 | 3 | 0.5 |
| EXAMPLE 8 | $H_3PO_4$ | 6.0 | $SnCl_4 \cdot 5H_2O$ | 0.7 | 60 | 3 | 0.5 |
| EXAMPLE 9 | $H_3PO_4$ | 6.0 | $SnCl_4 \cdot 5H_2O$ | 0.3 | 60 | 3 | 0.5 |
| EXAMPLE 10 | $H_3PO_4$ | 6.0 | $SnCl_4 \cdot 5H_2O$ | 0.3 | 40 | 1 | 0.5 |
| EXAMPLE 11 | $H_3PO_4$ | 6.0 | $SnCl_4 \cdot 5H_2O$ | 4.0 | 60 | — | — |
| EXAMPLE 12 | $H_3PO_4$ | 6.0 | $SnCl_4 \cdot 5H_2O$ | 0.7 | 60 | — | — |
| EXAMPLE 13 | $H_3PO_4$ | 6.0 | $SnCl_4 \cdot 5H_2O$ | 4.0 | 60 | 6 | 5.0 |
| EXAMPLE 14 | $Na_3PO_4$ | 10.0 | $SnCl_4 \cdot 5H_2O$ | 2.7 | 70 | 3 | 1.0 |
| EXAMPLE 15 | $Na_3PO_4$ | 10.0 | $SnI_4$ | 3.4 | 70 | 3 | 1.0 |
| EXAMPLE 16* | $H_3PO_4$ | 6.0 | $SnCl_4 \cdot 5H_2O$ | 2.7 | 60 | 10 | 1.0 |
| EXAMPLE 17 | $H_3PO_4$ | 6.0 | $SnCl_2 \cdot 2H_2O$ | 0.14 | 60 | — | — |
| EXAMPLE 18 | $H_3PO_4$ | 6.0 | $SnCl_2 \cdot 2H_2O$ | 0.14 | 60 | 3 | 4.0 |
| EXAMPLE 19 | $H_3PO_4$ | 6.0 | $SnSO_4$ | 0.2 | 60 | 3 | 4.0 |
| COMPARATIVE EXAMPLE 1 | $H_3PO_4$ | 6.0 | $SnCl_4 \cdot 5H_2O$ | 2.7 | 60 | 3 | 1.0 |
| COMPARATIVE EXAMPLE 2 | $H_3PO_4$ | 6.0 | $SnCl_4 \cdot 5H_2O$ | 2.7 | 60 | 6 | 1.0 |
| COMPARATIVE EXAMPLE 3 | $H_3PO_4$ | 6.0 | $SnCl_4 \cdot 5H_2O$ | 4.0 | 60 | 6 | 8.0 |
| COMPARATIVE EXAMPLE 4 | $H_3PO_4$ | 6.0 | $SnCl_2 \cdot 2H_2O$ | 0.5 | 50 | — | — |
| COMPARATIVE EXAMPLE 5 | $H_3PO_4$ | 6.0 | — | 0 | 50 | — | — |
| COMPARATIVE EXAMPLE 6 | $H_3PO_4$ | 6.0 | — | 0 | 60 | — | — |
| COMPARATIVE EXAMPLE 7 | $H_3PO_4$ | 6.0 | $SnCl_4 \cdot 5H_2O$ | 2.7 | 60 | 10 | 1.0 |

| | IMMERSION TREATMENT | HEAT TREATMENT | | COATED AMOUNT | | | IR ABSORPTION |
|---|---|---|---|---|---|---|---|
| | IMMERSION | | SHEET | IN TERMS | COATING COMPOSITION | | SPECTRUM |
| | TIME (SEC) | METHOD | TEMPERATURE (° C.) | OF P ($mg/m^2$) | Sn/P (-) | O/P (-) | $I_{OH}/I_{PO}$ (-) |
| EXAMPLE 1 | — | INFRARED HEATING | 70 | 8.3 | 1.3 | 6.0 | 0.28 |
| EXAMPLE 2 | — | INFRARED HEATING | 70 | 11.2 | 1.2 | 6.1 | 0.27 |
| EXAMPLE 3 | — | INFRARED HEATING | 70 | 7.0 | 1.2 | 6.0 | 0.27 |
| EXAMPLE 4 | — | INFRARED HEATING | 120 | 6.8 | 1.2 | 5.3 | 0.23 |
| EXAMPLE 5 | — | INFRARED HEATING | 200 | 7.1 | 1.2 | 4.6 | 0.19 |
| EXAMPLE 6 | — | INFRARED HEATING | 60 | 6.8 | 1.1 | 8.5 | 0.29 |
| EXAMPLE 7 | — | INFRARED HEATING | 70 | 5.0 | 1.2 | 6.0 | 0.27 |
| EXAMPLE 8 | — | INFRARED HEATING | 70 | 3.5 | 1.2 | 6.0 | 0.26 |
| EXAMPLE 9 | — | INFRARED HEATING | 70 | 2.2 | 1.2 | 5.9 | 0.25 |
| EXAMPLE 10 | — | INFRARED HEATING | 70 | 1.2 | 1.2 | 5.8 | 0.22 |
| EXAMPLE 11 | 2.0 | INDUCTION HEATING | 70 | 4.5 | 1.1 | 6.0 | 0.26 |
| EXAMPLE 12 | 1.0 | INDUCTION HEATING | 80 | 1.0 | 1.1 | 5.5 | 0.25 |
| EXAMPLE 13 | 5.0 | INDUCTION HEATING | 60 | 45.5 | 1.0 | 8.9 | 0.28 |
| EXAMPLE 14 | — | INFRARED HEATING | 70 | 6.1 | 1.2 | 6.0 | 0.28 |
| EXAMPLE 15 | — | INFRARED HEATING | 70 | 3.8 | 1.2 | 6.1 | 0.24 |
| EXAMPLE 16* | — | INFRARED HEATING | 70 | 7.0 | 1.3 | 5.4 | 0.22 |
| EXAMPLE 17 | 5.0 | INFRARED HEATING | 70 | 2.5 | 1.2 | 6.0 | 0.27 |
| EXAMPLE 18 | — | INFRARED HEATING | 70 | 3.5 | 1.2 | 6.0 | 0.27 |
| EXAMPLE 19 | — | INFRARED HEATING | 70 | 3.7 | 1.2 | 5.9 | 0.27 |
| COMPARATIVE EXAMPLE 1 | — | INFRARED HEATING | 55 | 7.2 | 1.1 | 9.2 | 0.32 |
| COMPARATIVE EXAMPLE 2 | — | NONE | — | 10.8 | 1.0 | 10.0 | 0.35 |

TABLE 1-continued

| | | | | | | | |
|---|---|---|---|---|---|---|---|
| COMPARATIVE EXAMPLE 3 | 5.0 | INFRARED HEATING | 70 | 62.0 | 1.4 | 6.4 | 0.30 |
| COMPARATIVE EXAMPLE 4 | 1.0 | INFRARED HEATING | 220 | 0.8 | 1.2 | 4.3 | 0.15 |
| COMPARATIVE EXAMPLE 5 | 5.0 | NONE | — | 1.0 | 0.9 | 10.0 | 0.33 |
| COMPARATIVE EXAMPLE 6 | 2.0 | INFRARED HEATING | 70 | 0.6 | 0.9 | 6.0 | 0.23 |
| COMPARATIVE EXAMPLE 7 | — | INFRARED HEATING | 260 | 8.2 | 1.3 | 3.5 | 0.15 |

*Washing was performed before heating

TABLE 2

| | GROWTH PROPERTIES OF TIN OXIDE | PAINT ADHESION | CORROSION RESISTANCE |
|---|---|---|---|
| EXAMPLE 1 | ○ | ◎ | ◎ |
| EXAMPLE 2 | ○ | ◎ | ◎ |
| EXAMPLE 3 | ○ | ◎ | ◎ |
| EXAMPLE 4 | ○ | ○ | ◎ |
| EXAMPLE 5 | ○ | ○ | ◎ |
| EXAMPLE 6 | ○ | ○ | ◎ |
| EXAMPLE 7 | ○ | ◎ | ◎ |
| EXAMPLE 8 | ○ | ◎ | ◎ |
| EXAMPLE 9 | ○ | ◎ | ○ |
| EXAMPLE 10 | ○ | ○ | ○ |
| EXAMPLE 11 | ○ | ◎ | ◎ |
| EXAMPLE 12 | ○ | ○ | ○ |
| EXAMPLE 13 | ○ | ○ | ◎ |
| EXAMPLE 14 | ○ | ◎ | ◎ |
| EXAMPLE 15 | ○ | ◎ | ◎ |
| EXAMPLE 16 | ○ | ◎ | ◎ |
| EXAMPLE 17 | ○ | ◎ | ◎ |
| EXAMPLE 18 | ○ | ◎ | ◎ |
| EXAMPLE 19 | ○ | ◎ | ◎ |
| COMPARATIVE EXAMPLE 1 | Δ | Δ | ◎ |
| COMPARATIVE EXAMPLE 2 | X | X | ◎ |
| COMPARATIVE EXAMPLE 3 | ○ | Δ | Δ |
| COMPARATIVE EXAMPLE 4 | Δ | Δ | ○ |
| COMPARATIVE EXAMPLE 5 | X | X | X |
| COMPARATIVE EXAMPLE 6 | ○ | X | X |
| COMPARATIVE EXAMPLE 7 | X | X | X |

INDUSTRIAL APPLICABILITY

Since having superior appearance, paint adhesion, and corrosion resistance, our tin-plated steel sheets can be used in various applications and, in particular, can be used for cans such as DI cans, food cans, and beverage cans.

The invention claimed is:

1. A tin-plated steel sheet comprising:

a plating layer containing tin on at least one surface of a steel sheet; and a chemical conversion coating consisting of P, O, H and tin on the plating layer, wherein 1) a coated amount of the chemical conversion coating per surface is 1.0 to 50 mg/m$^2$ in terms of P, an atomic ratio Sn/P obtained from the intensity of a P2p peak and that of a Sn3d peak of the chemical conversion coating is in the range of 1.0 to 1.3, the intensities being measured at the surface thereof using an x-ray photoelectron spectroscopic method, 2) an atomic ratio 0/P obtained from the intensity of the P2p peak and that of an O1s peak is in the range of 4.0 to 9.0, and optionally, 3) a ratio $I_{OH}/I_{PO}$ between reflection-absorbance intensity of a PO bond ($I_{PO}$) and reflection-absorbance intensity of an OH bond ($I_{OH}$) of an infrared absorption spectrum of the chemical conversion coating is in the range of 0.18 to 0.30.

2. A tin-plated steel sheet comprising:

a steel sheet;

a plating layer containing tin on at least one surface of the steel sheet; and a chemical conversion coating consisting of P, O, H and tin on the plating layer in a coated amount of 1.0 to 50 mg/m$^2$ in terms of P and having an atomic ratio Sn/P obtained from intensity of a P2p peak and that of a Sn3d peak of the chemical conversion coating in the range of 1.0 to 1.3, wherein 1) the intensities are measured at a surface of the chemical conversion coating with an x-ray photoelectron spectroscopic method, 2) an atomic ratio 0/P obtained from the intensity of the P2p peak and that of an O1s peak is in the range of 4.0 to 9.0, and optionally 3) a ratio $I_{OH}H/I_{PO}$ between reflection-absorbance intensity of a PO bond ($I_{PO}$) and reflection-absorbance intensity of an OH bond ($I_{OH}$) of an infrared absorption spectrum of the chemical conversion coating is in the range of 0.18 to 0.30.

3. A tin-plated steel sheet comprising:

a plating layer containing tin on at least one surface of a steel sheet; and a chemical conversion coating consisting of P, O, H and tin on the plating layer, wherein a coated amount of the chemical conversion coating per surface is 1.0 to 50 mg/m$^2$ in terms of P, an atomic ratio Sn/P obtained from the intensity of a P2p peak and that of a Sn3d peak of the chemical conversion coating is in the range of 1.0 to 1.3, the intensities being measured at the surface thereof using an x-ray photoelectron spectroscopic method, and an atomic ratio 0/P obtained from the intensity of the P2p peak and that of an O1s peak is in the range of 4.0 to 9.0.

* * * * *